US007976350B2

(12) United States Patent
Ho

(10) Patent No.: US 7,976,350 B2
(45) Date of Patent: Jul. 12, 2011

(54) ELECTRICAL CONNECTOR

(75) Inventor: Hsin-Tsung Ho, Taipei Hsien (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 90 days.

(21) Appl. No.: 12/626,829

(22) Filed: Nov. 27, 2009

(65) Prior Publication Data

US 2011/0130040 A1 Jun. 2, 2011

(51) Int. Cl.
*H01R 13/514* (2006.01)

(52) U.S. Cl. ..... 439/731; 439/607.51; 439/76.1; 439/686

(58) Field of Classification Search ..... 439/731, 439/686, 76.1, 465, 607.5, 607.51
See application file for complete search history.

(56) References Cited

U.S. PATENT DOCUMENTS 5,934,942 A * 8/1999 Patel et al. ..... 439/607.5
6,558,183 B1 * 5/2003 Ji et al. ..... 439/358
6,607,397 B1 * 8/2003 Zhang et al. ..... 439/357
7,607,947 B1 * 10/2009 Ho ..... 439/607.36
7,651,375 B2 * 1/2010 Zhu et al. ..... 439/607.41

* cited by examiner

*Primary Examiner* — Xuong M Chung Trans
(74) *Attorney, Agent, or Firm* — WPAT, P.C.; Anthony King

(57) ABSTRACT

An electrical connector includes an insulating housing, a plurality of electric terminals disposed in the insulating housing and an insulating cover assembly. An upper side and a lower side of the rear end of the insulating housing define a first locating cavity and a second locating cavity, respectively. The insulating cover assembly includes an upper cover and a lower cover mated with each other. The upper cover has a first locating portion protruded downward from a portion thereof. The lower cover has a second locating portion protruded upward from a portion thereof. When the insulating cover assembly is rightly assembled with the insulating housing, the locating portions are received in the corresponding locating cavities. When the insulating cover assembly is falsely assembled with the insulating housing, the locating portions are interfered with the insulating housing to prevent the false assembly of the insulating cover assembly and the insulating housing.

4 Claims, 6 Drawing Sheets

ELECTRICAL CONNECTOR

BACKGROUND OF THE INVENTION

1. Field of the Invention

The present invention generally relates to an electrical connector, and more particularly to an I/O connector.

2. The Related Art

A conventional electrical connector includes an insulating housing, a plurality of electric terminals disposed in the insulating housing and an insulating cover assembly surrounding a rear end of the insulating housing. The insulating cover assembly has an upper cover covering a top of the insulating housing and a lower cover covering a bottom of the insulating housing. However, the electrical connector has no fool-proof structure for preventing the insulating cover assembly from mistakenly assembling with the insulating housing, so the assembly time of the electrical connector is likely to be delayed. Therefore, an electrical connector capable of overcoming the foregoing problem is required.

SUMMARY OF THE INVENTION

An object of the present invention is to provide an electrical connector for contacting a mating connector. The electrical connector includes an insulating housing, a plurality of electric terminals disposed in the insulating housing, an insulating cover assembly surrounding a rear end of the insulating housing by a front end of the insulating cover assembly and a circuit board. An upper side and a lower side of the rear end of the insulating housing define a first locating cavity and a second locating cavity, respectively. The electric terminal has a contact portion for contacting with the mating connector and a soldering portion for being exposed from the rear end of the insulating housing. The insulating cover assembly includes an upper cover and a lower cover mated with each other. The upper cover has a first locating portion protruded downward from a portion thereof. The lower cover has a second locating portion protruded upward from a portion thereof. When the insulating cover assembly is rightly assembled with the insulating housing, the first and second locating portions are received in the first and second locating cavities. When the insulating cover assembly is falsely assembled with the insulating housing, the first and second locating portions are interfered with the insulating housing to prevent the false assembly of the insulating cover assembly and the insulating housing. The circuit board is located in the insulating cover assembly for electrically connecting with the soldering portions of the electric terminals which are extended into the insulating cover assembly.

As described above, by the design of the first and second locating portions, the first and the second locating cavities, the electrical connector can prevent the insulating cover assembly from mistakenly assembling with the insulating housing so as to shorten the assembly time of the electrical connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
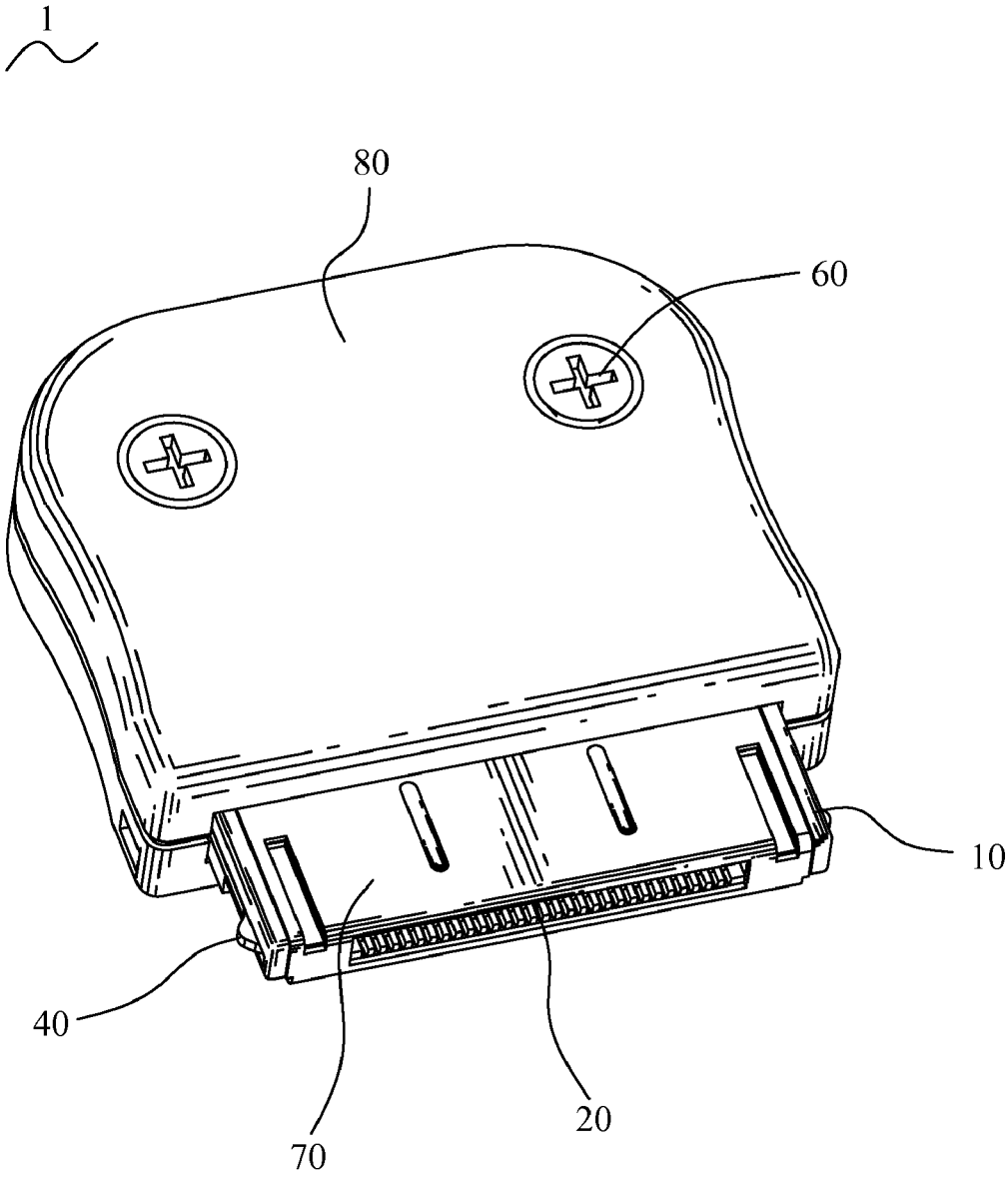
FIG. 1 is a perspective view of an electrical connector in accordance with the present invention.
Figure 2:
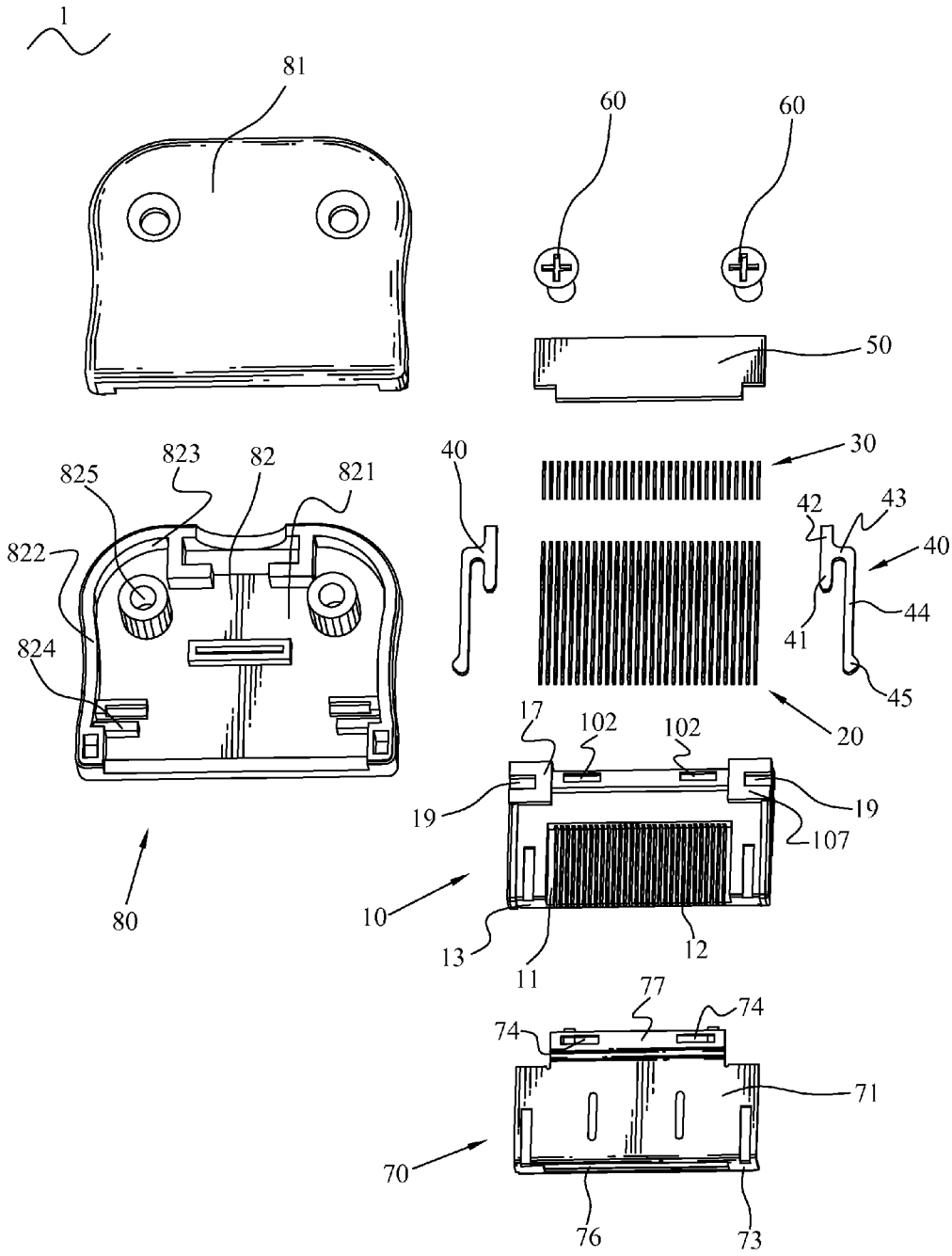
FIG. 2 is an exploded view of the electrical connector of FIG. 1.

Referring to FIG. 1 and FIG. 2, an electrical connector 1 according to the present invention is shown. The electrical connector 1 includes an insulating housing 10, a plurality of electric terminals 20, a plurality of holding bars 30, a pair of fastening members 40, a substantial rectangular printed circuit board 50, a pair of fixing elements 60, a shell 70 and an insulating cover assembly 80 surrounding a rear end of the insulating housing 10.

Figure 3:
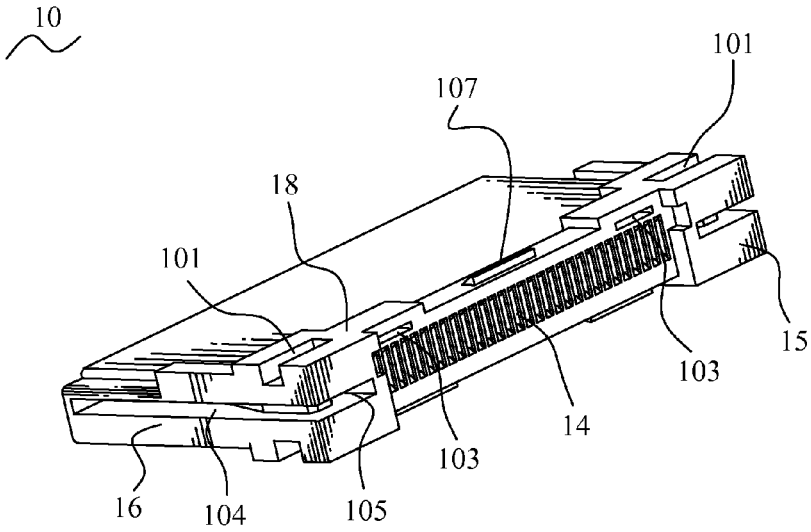
FIG. 3 is a perspective view of an insulating housing of the electrical connector of FIG. 1.
Figure 4:
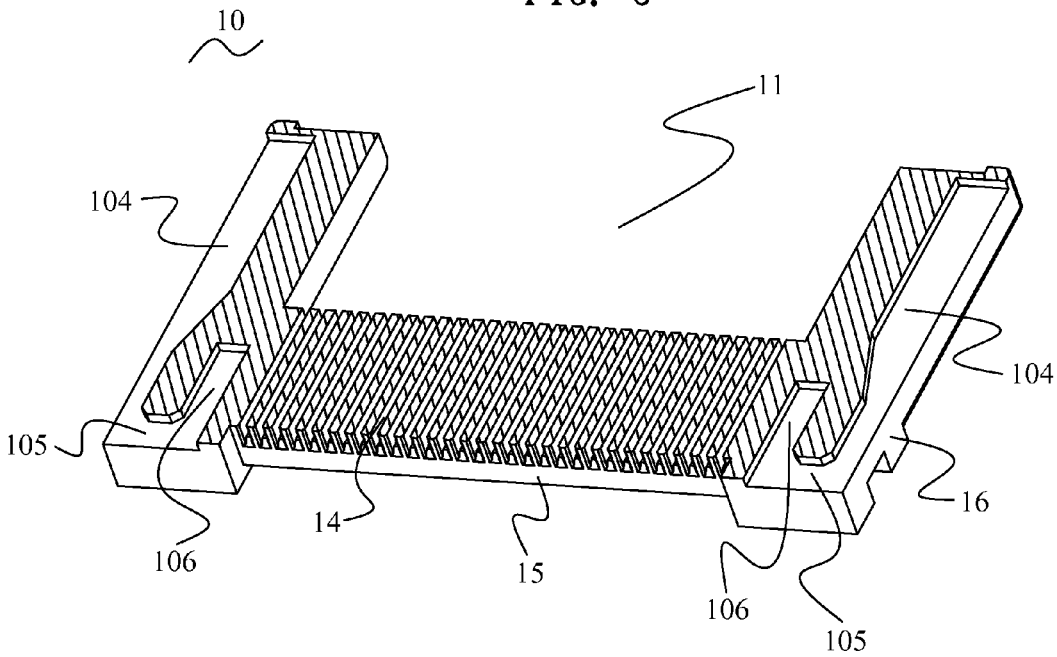
FIG. 4 is a sectional view of the insulating housing of the electrical connector of FIG. 1.

Referring to FIGS. 2-4, the insulating housing 10 is of substantial rectangular shape and disposed levelly. A front of the insulating housing 10 defines a rectangular mouth 11 extending transversely and opened freely. A top surface of the mouth 11 defines a plurality of first receiving cavities 12 arranged at regular intervals along a transverse direction thereof each extending longitudinally to pass through a front surface 13 of the insulating housing 10. A rear end of each of the first receiving cavities 12 further extends rearward to form a second receiving cavity 14 extending longitudinally to pass through a rear surface 15 of the insulating housing 10. Two rear corners of the insulating housing 10 are protruded upward and downward to form two top blocks 17 and two bottom blocks 18, respectively. Each of the top blocks 17 defines a rectangular first locating cavity 19 extending transversely to penetrate outside thereof. Each of the bottom blocks 18 defines a rectangular second locating cavity 101 extending transversely to penetrate outside thereof. The second locating cavity 101 is longer than the first locating cavity 19. A rear of the insulating housing 10 defines a pair of first wedges 102 spaced from each other and located between the two top blocks 17, and a second wedge 107 located between the bottom blocks 18. The bottom block 18 further defines a pair of buckling slots 103 passing therethrough transversely and lower than the second receiving cavity 14 of the insulating housing 10. The insulating housing 10 further defines an L-shaped recess including a rectangular shallow depression 104 defined in a side surface 16 and a rectangular fixing groove 105 defines in the rear surface 15 to make the recess span a corresponding rear side corner of the insulating housing 10. A free end of the fixing groove 105 extends inward to form a receiving fillister 106 paralleling to the shallow depression 104.

Figure 6:
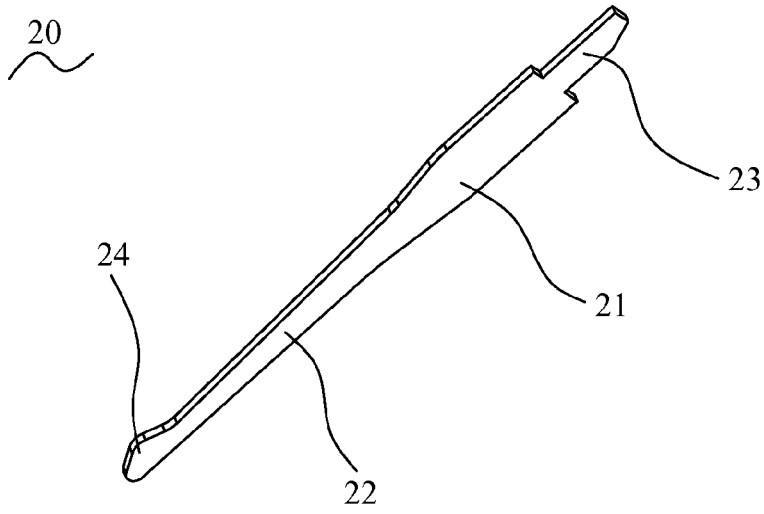
FIG. 6 is a perspective view of an electric terminal of the electrical connector of FIG. 1.

Referring to FIG. 2 and FIG. 6, each of the electric terminals 20 has a rectangular base bar 21 disposed vertically and extending longitudinally. Two opposite ends of the base bar 21 extend oppositely to form an extending portion 22 extending longitudinally and a soldering portion 23. A tip end of the extending portion 22 protrudes outward to form a contact portion 24.

Referring to FIG. 2 again, each of the fastening members 40 has a base arm 41 disposed levelly and extending longitudinally. One end of the base arm 41 extends along an extending direction of the base arm 41 to form a soldering tail 42. The fastening member 40 further has a connecting arm 43 extending transversely and an elastic arm 44 extending longitudinally. Two opposite ends of the connecting arm 43 are perpendicularly connected with a substantially middle of the base arm 41 and one end of the elastic arm 44 respectively so as to make the elastic arm 44 paralleling to the base arm 41. The other end of the elastic arm 44 protrudes outward to form a projection 45. The projection 45 and the connecting arm 43 are located at two opposite sides of the elastic arm 44.

Figure 5:
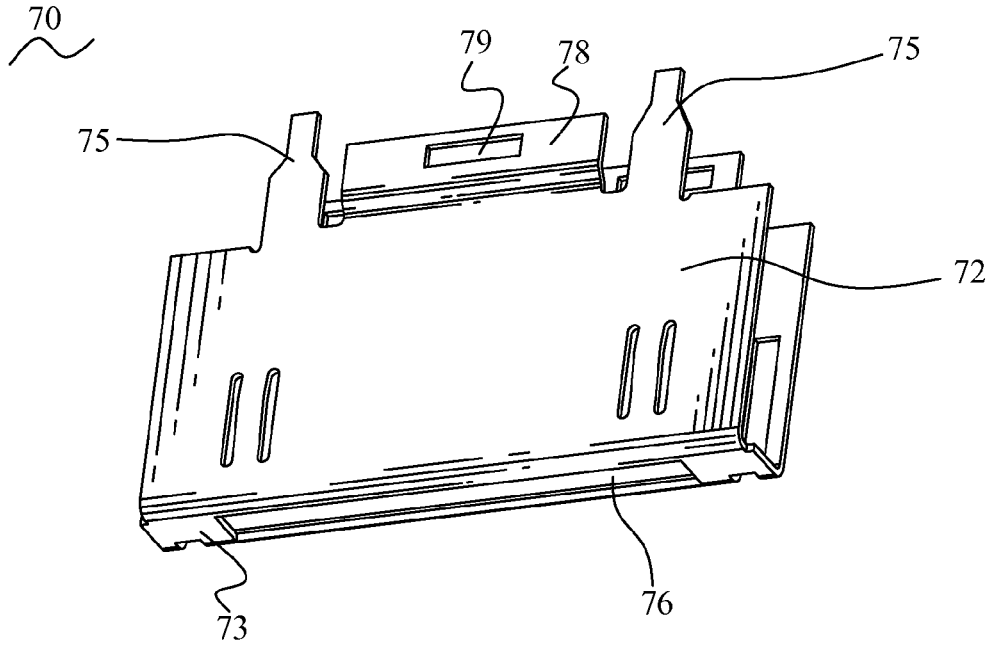
FIG. 5 is a perspective view of a shell of the electrical connector of FIG. 1.

Referring to FIG. 2 and FIG. 5, the shell 70 has a rectangular top board 71 disposed levelly and extending transversely, a rectangular bottom board 72 paralleling to the top board 71 and a connecting board 73 smoothly connecting front edges of the top board 71 and the bottom board 72. A middle of a rear edge of the top board 71 extends rearward to form a top rear board 77. A middle of a rear edge of the bottom board 72 extends rearward to form a bottom rear board 78. The top rear board 77 defines a pair of first positioning holes 74 spaced from each other and corresponding to the respective first wedges 102 of the insulating housing 10. The bottom rear board 78 defines a second positioning hole 79 corresponding to the second wedge 107. A rear edge of the bottom board 72 extends rearward to form two buckling portions 75 spaced from each other. The connecting board 73 defines a window 76 extending transversely and corresponding to the mouth 11 of the insulating housing 10.

Figure 7:
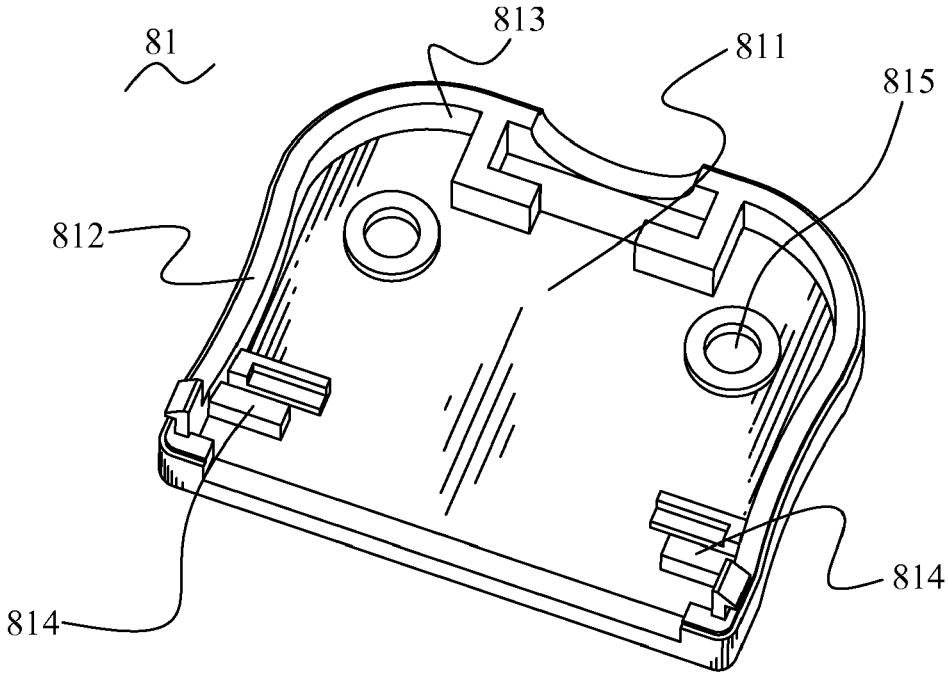
FIG. 7 is a perspective view of an upper cover of an insulating cover assembly of the electrical connector of FIG. 1.
Figure 8:
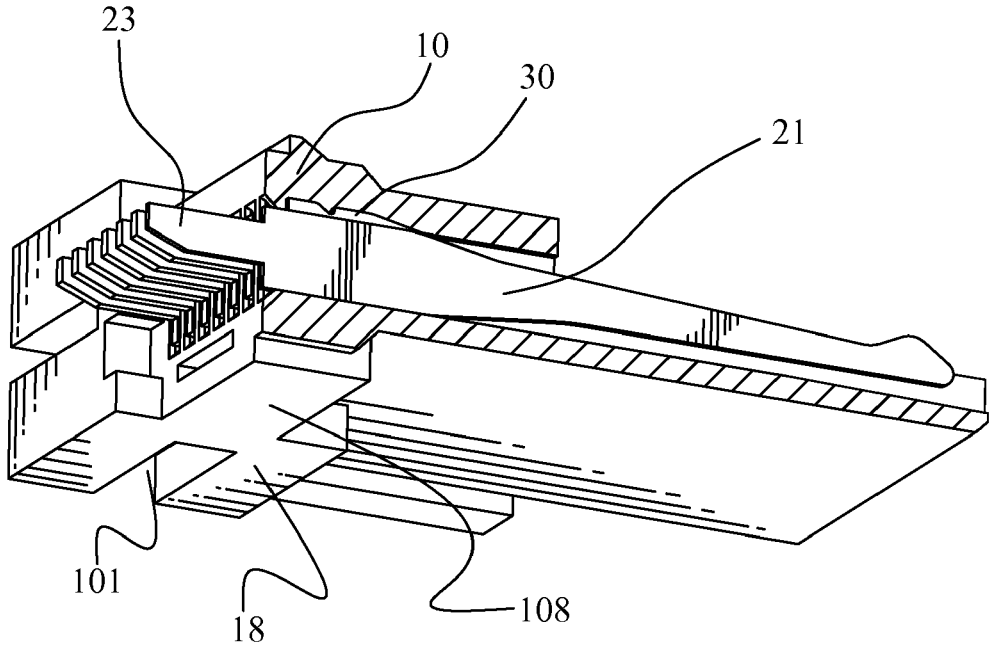
FIG. 8 is another sectional view of the insulating housing of the electrical connector of FIG. 1, with the electric terminals and holding bars held therein.
Figure 9:
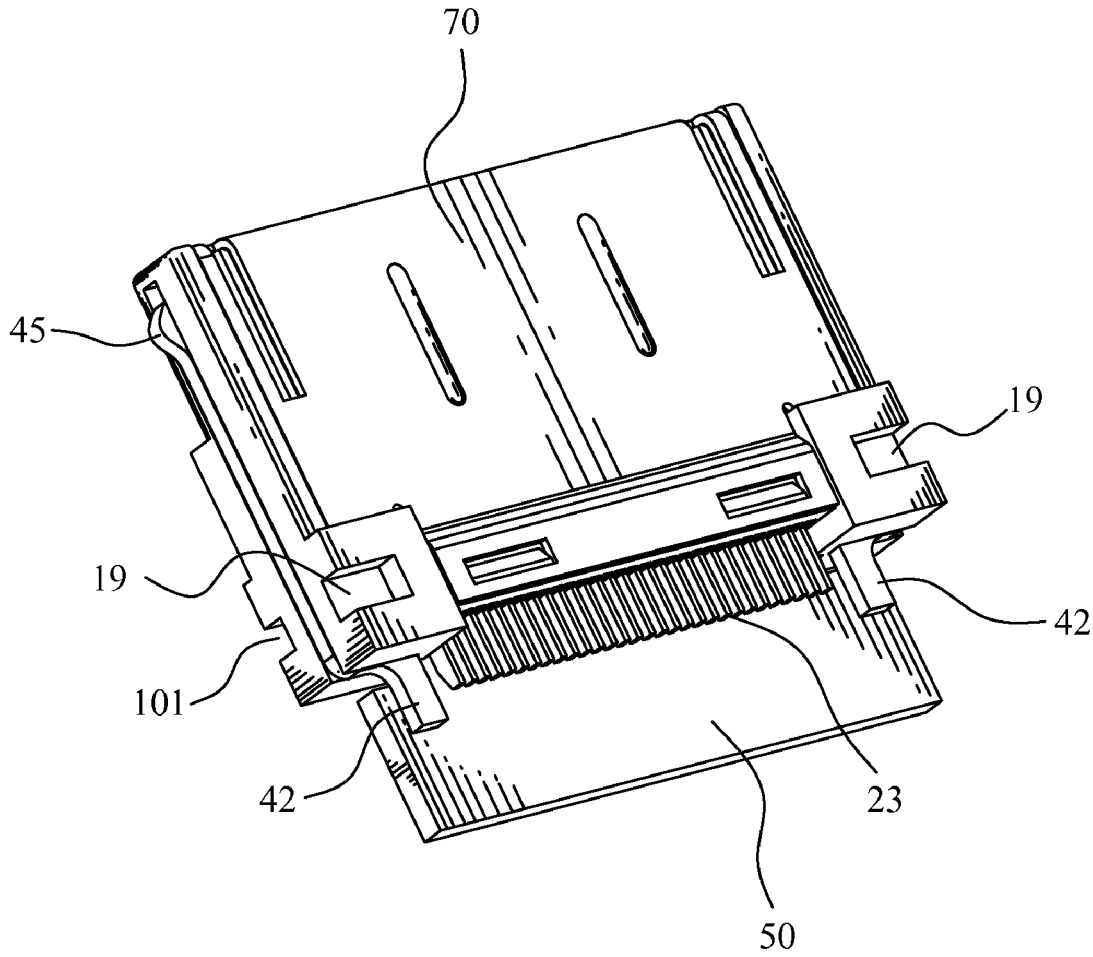
FIG. 9 is a perspective view of the electrical connector of FIG. 1 without the insulating cover assembly.

Referring to FIG. 2 and FIG. 7, the insulating cover assembly 80 has an upper cover 81 and a lower cover 82 mated with each other. The upper cover 81 has a substantial rectangular top board 811, a pair of first side boards 812 extending downward from two opposite sides of the top board 811, and a first rear board 813 extending downward from a rear edge of the top board 811 and connecting with the two first side boards 812. A portion of the top board 811 protrudes downward to form a pair of first locating portions 814 spaced from each other and corresponding to the respective first locating cavities 19 of the insulating housing 10. The top board 811 is further provided with a pair of first fixing holes 815 in rear of the first locating portions 814, spaced from each other and passing through the top board 811. The lower cover 82 has a substantial rectangular bottom board 821 disposed under the top board 811, a pair of second side boards 822 extending upward from two opposite sides of the bottom board 821, and a second rear board 823 extending upward from a rear edge of the bottom board 821 and connecting with the two second side boards 822. A portion of the bottom board 821 protrudes upward to form two second locating portions 824 spaced from each other and corresponding to the respective second locating cavities 101 of the insulating housing 10. The bottom board 821 is further provided with two second fixing holes 825 in rear of the second locating portions 824 and spaced from each other.

Referring to FIGS. 1-9, in assembly, the electric terminals 20 are inserted rearward to be disposed in the insulating housing 10. The base bar 21 of each of the electric terminals 20 is received in the corresponding second receiving cavity 14 of the insulating housing 10 and the extending portion 22 is received in the corresponding first receiving cavity 12 of the insulating housing 10 with the contact portion 24 exposed out of the first receiving cavity 12 for contacting a mating connector (not shown). The holding bars 30 are restricted in the corresponding second receiving cavities 14 of the insulating housing 10 and abut against the corresponding base bars 21 of the electric terminals 20 for forming a firm engagement between the electric terminals 20 and the insulating housing 10. The soldering portion 23 of the electric terminal 20 is exposed out of the rear end of the insulating housing 10 to be soldered with the printed circuit board 50. Each of the fastening members 40 is inserted forward with the base arm 41 being inserted into the receiving fillister 106 of the insulating housing 10, the connecting arm 43 being fixed in the fixing groove 105 and the elastic arm 44 being held in the shallow depression 104. The soldering tail 42 of the fastening member 40 which is in the substantial same plane as the soldering portions 23 of the electric terminals 20 is exposed out of the rear end of the insulating housing 10 to be soldered with the printed circuit board 50. The projection 45 of the fastening member 40 is exposed out of the corresponding side surface 16 of the insulating housing 10 for contacting the mating connector so as to make the mating connector grounding.

The shell 70 is mounted on the insulating housing 10 with the top rear board 77 being fastened between the top blocks 17 and the bottom rear board 78 being fastened between the bottom blocks 18. The wedges 102, 107 of the insulating housing 10 are held in the corresponding positioning holes 74, 79 of the shell 70. The two buckling portions 75 are buckled into the buckling slots 103 of the insulating housing 10 and further exposed out of the rear end of the insulating housing 10 for being soldered with the printed circuit board 50 so that make the printed circuit board 50 disposed between the soldering tails 42 of the fastening members 40 and the buckling portions 75 of the shell 70. The top board 71 and the bottom board 72 abut against a top surface and a bottom surface of the insulating housing 10, respectively. The connecting board 73 wraps a front edge of the insulating housing 10 with the window 76 corresponding and communicating to the mouth 11 of the insulating housing 10. The insulating cover assembly 80 surrounds the rear end of the insulating housing 10 by a front end thereof with the printed circuit board 50 disposed therein. The upper cover 81 covers a rear of a top of the insulating housing 10 and the top rear board 77, the lower cover 82 covers a rear of a bottom of the insulating housing 10 and the bottom rear board 78. The insulating housing 10 is exposed out of a front of the insulating cover assembly 80. The first locating portions 814 of the upper cover 81 are located in the corresponding first locating cavities 19 of the insulating housing 10 and the second locating portions 824 of the lower cover 82 are located in the corresponding second locating cavities 101 of the insulating housing 10, and the second locating cavity 101 is longer than the first locating cavity 19 so that prevent the insulating cover assembly 80 assembling with the insulating housing 10 mistakenly, that is, the first and second locating portions 814, 824 are received in the first and second locating cavities 19, 101 when the insulating cover assembly 80 is rightly assembled with the insulating housing 10; the first and second locating portions 814, 824 are interfered with the insulating housing 10 to prevent the false assembly of the insulating cover assembly 80 and the insulating housing 10 when the insulating cover assembly 80 is falsely assembled with the insulating housing 10. Then, the two fixing elements 60 are fixed in the corresponding second fixing holes 825 through the corresponding first fixing holes 815 to form a firm engagement between the upper cover 81 and the lower cover 82. In this embodiment, each of the fixing elements 60 is a screw.

As describe above, by the design of the first and second locating portions 814, 824, the first and the second locating cavities 19, 101, the electrical connector 1 can prevent the insulating cover assembly 80 from mistakenly assembling with the insulating housing 10 so as to shorten the assembly time of the electrical connector 1.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector for mating with a mating connector, comprising:

an insulating housing, an upper side and a lower side of a rear end of the insulating housing defining a first locating cavity and a second locating cavity, respectively;

a plurality of electric terminals disposed in the insulating housing, the electric terminal having a contact portion for contacting with the mating connector and a soldering portion for being exposed from the rear end of the insulating housing;

an insulating cover assembly surrounding the rear end of the insulating housing by a front end of the insulating cover assembly, the insulating cover assembly including an upper cover and a lower cover mated with each other, the upper cover having a first locating portion protruded downward from a portion thereof, the lower cover having a second locating portion protruded upward from a portion thereof, wherein when the insulating cover assembly is rightly assembled with the insulating housing, the first and second locating portions are received in the first and second locating cavities, when the insulating cover assembly is falsely assembled with the insulating housing, the first and second locating portions are interfered with the insulating housing to prevent the false assembly of the insulating cover assembly and the insulating housing; and a circuit board located in the insulating cover assembly for electrically connecting with the soldering portions of the electric terminals which are extended into the insulating cover assembly a shell covering the insulating housing, wherein the shell includes a top board and a bottom board, a middle of a rear edge of the top board extends rearward to form a top rear board, a middle of a rear edge of the bottom board extends rearward to form a bottom rear board, two rear corners of the insulating housing are protruded upward and downward to form two top blocks and two bottom blocks, respectively, the top rear board is fastened between the top blocks and located in the insulating cover assembly, the bottom rear board is fastened between the bottom blocks and located in the insulating cover assembly, each top block defines one first locating cavity for receiving corresponding first locating portion, each bottom block defines one second locating cavity for receiving corresponding second locating portion.

2. The electrical connector as claimed in claim 1, wherein a rear of the insulating housing has wedges located between the top blocks, the bottom blocks, respectively, the top rear board and the bottom rear board has positioning holes, respectively, for buckling with the corresponding wedges.

3. The electrical connector as claimed in claim 1, wherein a connecting board connects front edges of the top board and the bottom board and defines a widow.

4. The electrical connector as claimed in claim 1, wherein the first and second locating cavities are rectangular and penetrate outside thereof.

* * * * *